US011031204B2

(12) United States Patent
Connell

(10) Patent No.: US 11,031,204 B2
(45) Date of Patent: Jun. 8, 2021

(54) MOVABLE CONTACT ARM SET FOR SWITCHING CONTACTOR

(71) Applicant: Johnson Electric International AG, Murten (CH)

(72) Inventor: Richard Anthony Connell, Cambridgeshire (GB)

(73) Assignee: Johnson Electric International AG, Murten (CH)

( * ) Notice: Subject to any disclaimer, the term of this patent is extended or adjusted under 35 U.S.C. 154(b) by 350 days.

(21) Appl. No.: 16/145,262

(22) Filed: Sep. 28, 2018

(65) Prior Publication Data

US 2019/0035587 A1 Jan. 31, 2019

Related U.S. Application Data

(63) Continuation of application No. PCT/CN2017/078718, filed on Mar. 30, 2017.

(30) Foreign Application Priority Data

Apr. 1, 2016 (GB) ..... 1605576

(51) Int. Cl.
*H01H 50/64* (2006.01)
*H01H 50/54* (2006.01)
(Continued)

(52) U.S. Cl.
CPC ..... *H01H 50/641* (2013.01); *H01H 9/40* (2013.01); *H01H 50/54* (2013.01); *H01H 1/22* (2013.01); *H01H 3/32* (2013.01)

(58) Field of Classification Search
CPC ..... H01H 50/641; H01H 9/40; H01H 50/54; H01H 1/22; H01H 3/32; H01H 1/26; H01H 21/18; H01H 50/56
See application file for complete search history.

(56) References Cited

U.S. PATENT DOCUMENTS 3,562,459 A * 2/1971 Bould ..... H01H 9/386 218/18
3,662,311 A * 5/1972 Snider ..... H01H 37/54 337/367

(Continued)

FOREIGN PATENT DOCUMENTS

EP 2613332 A1 7/2013

OTHER PUBLICATIONS

International Search Report of PCT Patent Application No. PCT/CN2017/078718 dated Jul. 12, 2017.

*Primary Examiner* — Mohamad A Musleh

(57) ABSTRACT

A movable contact arm set for a switching contactor includes first and second movable contact arms which respectively carry first and second movable contacts. The first and second movable contact arms respectively include first and second engagement surfaces which are engagable with an actuation to permit displacement of the first and second movable contacts. The first and second engagement surfaces are asymmetric to one another to permit asynchronous displacement of the first and second movable contacts. A switching contactor, movable contact arm for use with a movable contact arm set, and a method of providing a lead-lag contact opening arrangement for a switching contactor are also provided.

13 Claims, 6 Drawing Sheets

(51) Int. Cl.

| | |
|---|---|
| ***H01H 9/40*** | (2006.01) |
| *H01H 1/22* | (2006.01) |
| *H01H 3/32* | (2006.01) |

(56) References Cited

U.S. PATENT DOCUMENTS

| | | | | | |
|---|---|---|---|---|---|
| 3,858,957 | A * | 1/1975 | Harwood | H01R 12/82 | 439/59 |
| 4,551,589 | A * | 11/1985 | Bowling | H01H 43/125 | 200/38 A |
| 4,712,079 | A * | 12/1987 | Marquardt | H01H 50/545 | 200/431 |
| 5,597,989 | A * | 1/1997 | Nishio | H01H 23/168 | 200/437 |
| 9,318,818 | B2 * | 4/2016 | Nakamura | H01R 13/111 | |
| 2008/0186126 | A1 * | 8/2008 | Ying | H02J 7/0068 | 337/333 |
| 2009/0318000 | A1 * | 12/2009 | Connell | H01H 1/54 | 439/251 |
| 2013/0178086 | A1 * | 7/2013 | Connell | H01H 50/648 | 439/251 |
| 2015/0015348 | A1 * | 1/2015 | Connell | H01H 3/001 | 335/15 |
| 2015/0015349 | A1 * | 1/2015 | Connell | H01H 50/546 | 335/15 |

* cited by examiner

MOVABLE CONTACT ARM SET FOR SWITCHING CONTACTOR

CROSS REFERENCE TO RELATED APPLICATIONS

This non-provisional patent application is continuation application of PCT Application No. PCT/CN2017/078718, filed with the Chinese Patent Office on Mar. 30, 2017, which claims priority to British Patent Application No. 1605576.6, filed on Apr. 1, 2016, all of which are incorporated herein by reference in their entirety.

FIELD OF INVENTION

The present invention relates to a movable contact arm set, in particular but not necessarily exclusively for use with switching contactors. The invention further relates to a switching contact, to a movable arm for a movable contact arm set, and also to a method of providing a lead-lag contact opening arrangement for a switching contactor.

BACKGROUND OF THE INVENTION

It is often desirable to provide switching contactors current-sharing arm arrangements, wherein a plurality of different movable arms is provided which can be actuated to open and close a switch. By providing a means by which the different movable contacts of the switching contactor can close one after another, a lead-lag contact arrangement can be constructed. This is advantageous in that current can be shared across the various movable contacts, limiting the danger of plasma discharge or electrical arcing, which in turn allows some of the movable contacts to be reduced in size, improving the cost-effectiveness of manufacture of the switching contactors.

Typically, lead-lag arrangements have been created by providing a single movable contact arm which is split into individual blades, each blade having one or more movable contacts mounted thereto. This permits current sharing across the blades. The individual blades will then be biased in order that one or more blades open and close their respective movable contacts in advance of the remaining contacts, thereby creating a lead-lag closure arrangement. However, such biased blade arrangements can be both expensive and complicated to manufacture, and alternative means of providing a lead-lag contact arrangement would be beneficial. Biased blades are also reliant on correct actuation of the movable arms in order to ensure a correct opening and closing sequence, and are therefore reliant on more powerful actuator arrangements than might be desirable.

SUMMARY OF THE INVENTION

The present invention seeks to provide a movable contact arm set and switching contactor so as to obviate or limit the above-mentioned problems.

According to a first aspect of the invention, there is provided a movable contact arm set for a switching contactor, the movable contact arm set comprising: first and second movable contact arms which respectively carry first and second movable contacts, the first and second movable contact arms respectively having first and second engagement surfaces which are engagable with an actuation element to permit displacement of the first and second movable contacts, the first and second engagement surfaces being asymmetric to one another to permit asynchronous said displacement.

By providing two movable arms in a set which are asymmetric to one another permits a linear actuation force from a movable member of an actuator to ensure that the movable contact arms, and by extension, the movable contacts are opened in the correct sequence. The shaping of the movable contact arms is such that the sequence of opening and closing of the movable contact arms is always executed correctly.

Whereas existing blades of movable members may be offset and angle symmetrically to the contact end, there exists a short distance prior to the engagement of a wedge-shaped member with points of engagement of the blades in which highly accurate and consistent manufacturing must be provided in order to achieve consistent pick-up of the movable members. This can lead to lateral displacement or shuffling of the blades when the wedge-shaped member enters engagement. The present invention provides long engagement surfaces which beneficially create a smooth pick-up of the movable members, providing consistent opening timings for contactors.

Preferably, each of the first and second movable contact arms may have an elongate body having a stepped portion therein, the respective stepped portions defining the first and second engagement surfaces. Each of the stepped portions of the first and second movable contact arms may then comprise primary and secondary shoulders which are different to each other.

In one embodiment, a stepped portion of the first movable contact arm may be larger than the stepped portion of the second movable contact arm. Preferably, the stepped portion of the first movable contact may be larger than the stepped portion of the second movable contact arm in a direction of a longitudinal axis of the respective elongate bodies. Additionally or alternatively, the stepped portion of the first movable contact arm is larger than the stepped portion of the second movable contact arm in a direction perpendicular to a longitudinal axis of the respective elongate bodies.

The specifically stepped or shouldered shape of the movable contact arms ensures that a physical contact between a movable member of an actuator produces a reproducible and accurate opening and closing stroke of the switching contactor, without any potential for significant lag between actuator motion and opening or closing of the contacts. This ensures that a steady opening or closing of the contacts can be produced so as to minimise the risk of electrical arcing.

Optionally, a leading edge of the first engagement surface may be positioned further from the first movable contact than a leading edge of the second engagement surface is from the second movable contact. Furthermore, an angular orientation of the first engagement surface may be different to that of the second engagement surface.

Spacing apart the leading edges of the engagement surfaces, which define a pick-up point for the movable member of the actuator, ensures the asynchronicity of the displacement of the movable contact arms. Modification of the slopes of the engagement surfaces can also advantageously alter the opening and closing characteristics of the switching contactor, which may assist with creating the best opening and closing timing sequences.

Preferably, the first movable contact may be formed as a lead contact and the second movable contact is formed as a lag contact.

The provision of a lead-lag contact arrangement ensures that the risk of electrical arcing or plasma discharge can be minimised for the lag blades, allowing the manufacturer to minimise the amount of electrically conductive and traditionally expensive material of the movable contacts which is used. This beneficially produces a more cost-effective movable contact arm set.

According to a second aspect of the invention, there is provided a switching contactor comprising: first and second terminals; a moveable contact arm set, preferably in accordance with the first aspect of the invention, the first and second movable contact arms being connected to the first terminal; first and second fixed contacts connected to the second terminal; and an actuation element having a movable member engagable with the first and second engagement surfaces to permit asynchronous displacement of the first and second movable contacts relative to the first and second fixed contacts.

Preferably, the movable member may be a wedge-shaped member engagable with the first and second engagement surfaces, and the wedge-shaped member may have an stepped actuation surface.

A switching contactor having a lead-lag contact arrangement is less likely to become damaged during use, requiring less maintenance, and therefore being more cost-effective to operate over a set period of time. Improvements to the lead-lag arrangement can also reduce the propensity for contact closure bounce, which in turn increases the risk of electrical arcing.

According to a third aspect of the invention, there is provided a movable contact arm for use with a movable contact arm set, preferably in accordance with the first aspect of the invention, the movable contact arm comprising: an electrically-conductive elongate body having a stepped portion which includes a contact-clearance shoulder, an engagement shoulder, and a moving-member-engagement body portion which is positioned between the contact-clearance and engagement shoulders, the moving-member-engagement body portion defining an engagement surface which is engagable with a movable member of an actuation element to permit displacement of the movable contact arm.

Preferably, the elongate body may be formed from a resiliently flexible electrically-conductive material.

According to a fourth aspect of the invention, there is provided a method of providing a lead-lag contact opening arrangement for a switching contactor, the method comprising the steps of providing a pair of movable contact arms of the switching contactor which are asymmetric to one another, and applying a linear actuation force towards the pair of movable contact arms such that the movable contact arms are displaced asynchronously to one another.

Asynchronous contacting of a pair of movable contact arms can be achieved by producing asymmetric contact arms, thereby permitting a standard actuator arrangement to be used as part of a switching contactor. This can lead to a greater degree of miniaturisation of the components of the switching contactor, which can allow the use of such a switching contactor in a greater range of applications.

BRIEF DESCRIPTION OF THE FIGURES

The invention will now be more particularly described, by way of example only, with reference to the accompanying drawings, in which.

DETAILED DESCRIPTION OF THE INVENTION

Figure 1:
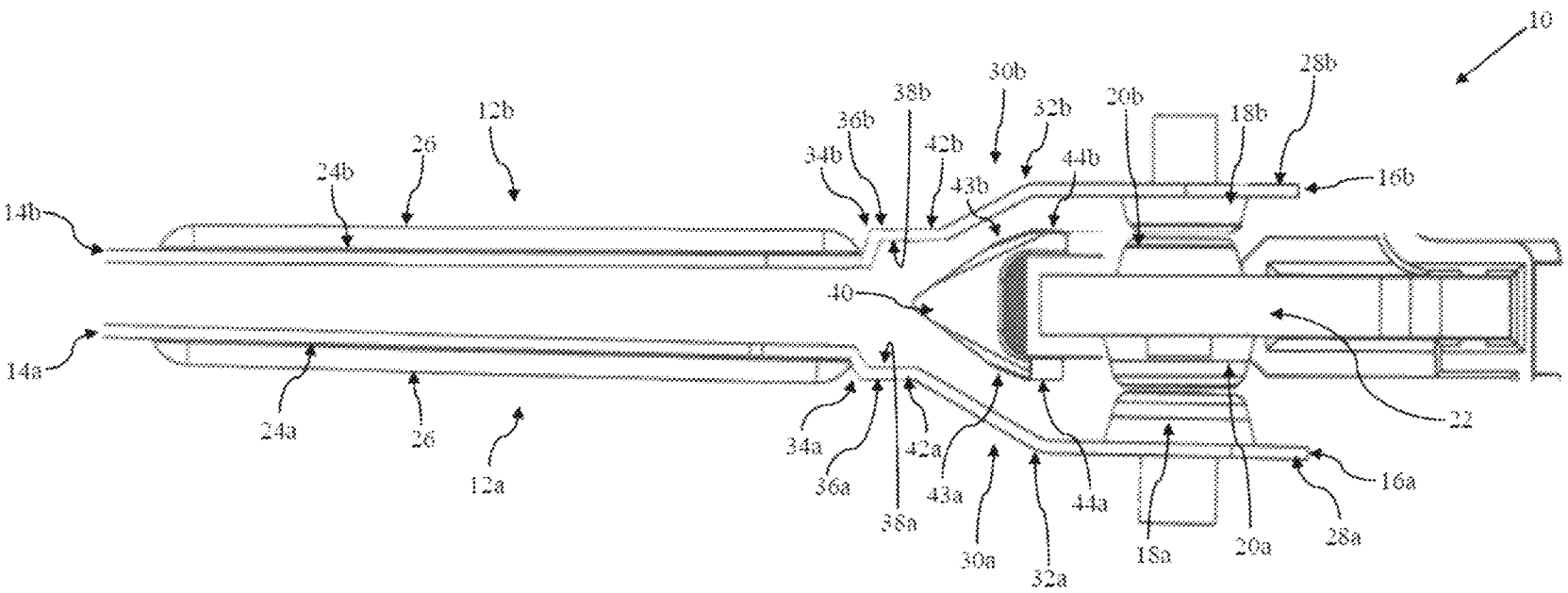
FIG. 1 shows a plan view of one embodiment of a movable contact arm set in accordance with the first aspect of the invention, the movable contact set being in a contacts-closed condition with fixed contacts of a contactor terminal.

Referring firstly to FIG. 1, there is provided a first embodiment of a movable contact arm set in a contacts-closed condition and indicated globally at 10, which comprises first and second movable contact arms 12*a*, 12*b* at least in part displaceable relative to one another.

Each of the first and second movable contact arms 12*a*, 12*b* has an elongate body 14*a*, 14*b*, the elongate bodies 14*a*, 14*b* preferably having identical longitudinal extents. The elongate bodies 14*a*, 14*b* are formed from an electrically conductive material, preferably a resiliently flexible material such as spring-grade copper or copper so as to allow flexion to permit the relative displacement of the first and second movable contact arms 12*a*, 12*b*.

The first and second movable contact arms 12*a*, 12*b* each have a first, or proximal, end, which is not illustrated in FIG. 1. This proximal end of each of the first and second movable contact arms 12*a*, 12*b* is here connected to a terminal through which current may flow. At or adjacent to a second, distal end 16*a*, 16*b* of each of the first and second movable contact arms 12*a*, 12*b* is mounted a first and second movable contact or contacts 18*a*, 18*b* respectively. These first and second movable contacts 18*a*, 18*b* are arranged so as to be contactable with corresponding first and second fixed contact 20*a*, 20*b* of a fixed terminal 22, for instance, within a switching contactor. Displacement of the first and second movable contact arms 12*a*, 12*b* relative to one another can effect the opening or closing of a contact set formed by the first and second movable contacts 18*a*, 18*b* and the first and second fixed contacts 20*a*, 20*b*.

The elongate bodies 14*a*, 14*b* of the first and second movable contact arms 12*a*, 12*b* are formed so as to have a major body portion 24*a*, 24*b*, which may be attached to a rigidifying member 26 such as that illustrated, and a minor body portion 28*a*, 28*b* to which the first or second movable contacts 18*a*, 18*b* are affixed. The first and second major and minor body portions 24*a*, 24*b*, 28*a*, 28*b* are laterally displaced relative to one another by a stepped portion 30*a*, 30*b* of the elongate bodies 14*a*, 14*b*, which forms a kinked, stepped or shouldered region thereof.

The stepped portions 30*a*, 30*b* of the first and second movable contact arms 12*a*, 12*b* may have primary and secondary different shoulders 32*a*, 32*b*, 34*a*, 34*b* to create a multi-stage stepped portion 30*a*, 30*b*. The primary, or contact-clearance shoulders 32*a*, 32*b* provide the necessary spacing between the first and second minor body portions 28*a*, 28*b* so as to permit the fixed terminal 22 and first and second fixed contacts 20*a*, 20*b* to be positioned between the first and second movable contacts 18*a*, 18*b* in use.

The secondary, or engagement shoulders 34*a*, 34*b* act to provide an asymmetry between the first and second movable contact arms 12*a*, 12*b*, either in a longitudinal or lateral direction of the elongate bodies 14*a*, 14*b*, or by providing a slightly different angular configuration of the stepped portions 30*a*, 30*b*. It will be appreciated, however, that a similar effect could feasibly be achieved by forming the primary shoulders 32*a*, 32*b* asymmetrically, and therefore a single step, kink or shoulder in the stepped portion 30*a*, 30*b* could be provided.

Between the contact-clearance and engagement shoulders 32*a*, 32*b*, 34*a*, 34*b*, there can be a moving-member-engagement body portion 36*a*, 36*b* which defines first and second engagement surfaces 38*a*, 38*b* on the opposed inner faces of the first and second movable contact arms 12*a*, 12*b*, which can be contacted by an actuation element, such as the movable member 40, preferably being a wedge-shaped member as shown, of a switching contactor actuator. In the embodiment shown, the first and second engagement surfaces 38*a*, 38*b* respectively define first and second leading edges 42*a*, 42*b* which are the first points of contact of the engagement surfaces 38*a*, 38*b* with the movable member 40. By positioning the first and second leading edges 42*a*, 42*b* so as to be spaced apart with respect to one another, an asymmetric actuation force can be created.

Whilst the difference in positioning of the first and second leading edges 42*a*, 42*b* is in a longitudinal direction of the elongate bodies 14*a*, 14*b*, it will be appreciated that a similar effect could be created by creating different lateral or perpendicular positioning of the first and second leading edges 42*a*, 42*b*. Furthermore, it is noted that whilst the leading edges 42*a*, 42*b* are referred to as such, it will be appreciated that leading is used to refer to the first part of the engagement surfaces 38*a*, 38*b* to come into contact with the actuation element, rather than necessary the longitudinally forward-most portion of the engagement surfaces 38*a*, 38*b*, that is, not necessarily the portion closest to the first or second movable contact 18*a*, 18*b*.

The effect of positioning the second leading edge 42*b* in advance of the first leading edge 42*a* can be achieved by providing a stepped portion 30*b* of the second movable contact arm 12*b* which is larger than the stepped portion 30*a* of the first movable arm 12*a*, ensuring that the second leading edge 42*b* is closer to the second movable contact 18*b* than the first leading edge 42*a* is to the first movable contact 18*a*.

Preferably, the first and second movable contacts 18*a*, 18*b* are respectively formed as lead and lag contacts, that is, the first movable contact or contacts 18*a* being larger than the second movable contactor contacts 18*b* and/or formed from a more resilient or long-lived electrically-conductive material. The first movable contact 18*a* is then arranged to close first and open second during a contact opening or closing action, therefore taking the brunt or majority of the effects of electrical arcing or similar deleterious effects associated with the opening and closing of contacts.

Figure 2A:
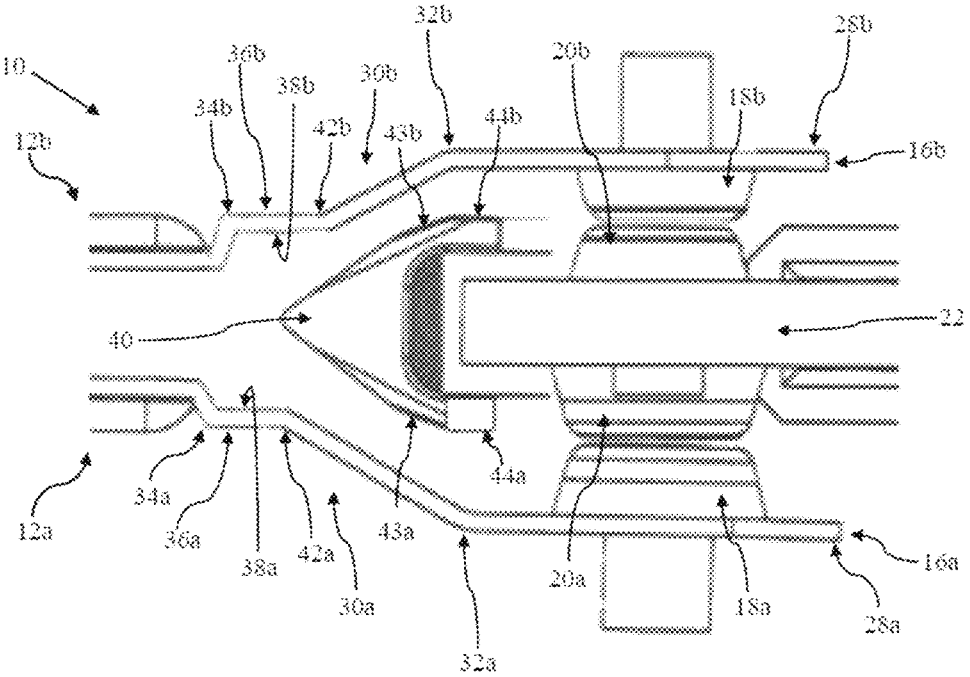
FIG. 2*a* shows an enlarged plan view of the contact region of the movable contact arm set of FIG. 1.

A contact opening process is illustrated by FIGS. 2*a* to 2*e*. FIG. 2*a* shows the movable contact arm set 10 in a contacts-closed condition with the fixed terminal 22. The movable member 40 of the actuation element is retracted, and does not contact with the engagement surfaces 38*a*, 38*b* of the first and second movable contact arms 12*a*, 12*b*. The first and second movable contacts 18*a*, 18*b* are both respectively in contact with the first and second fixed contacts 20*a*, 20*b*, and electrical current can flow through the first and second movable contact arms 12*a*, 12*b* through to the fixed terminal 22.

Figure 2B:
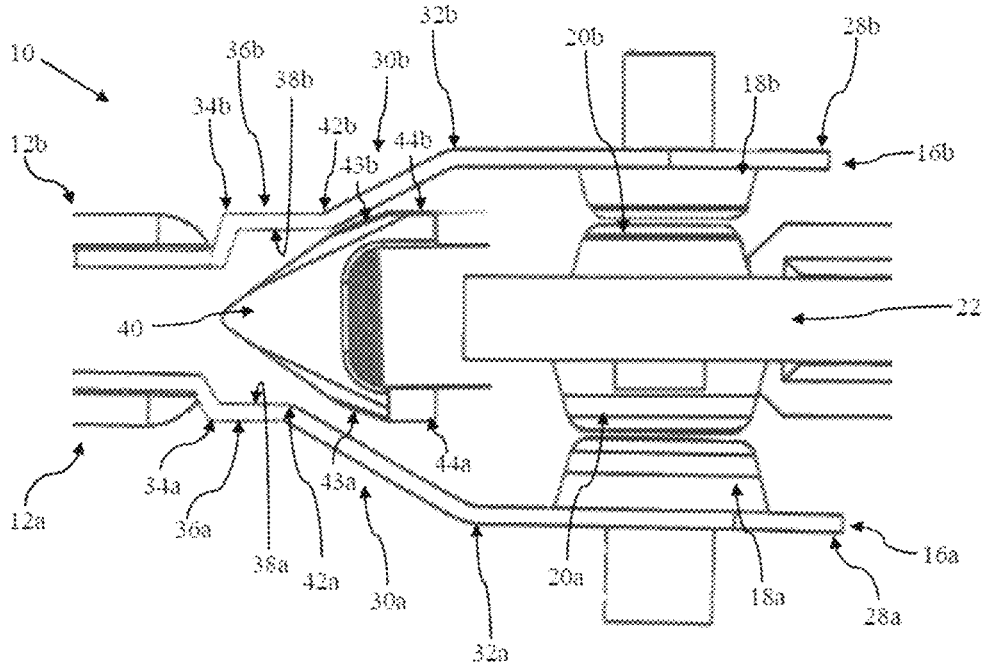
FIG. 2*b* shows an enlarged plan view of the contact region of the movable contact arm set of FIG. 2*a*, a wedge-shaped engagement member of an actuator having advanced to contact one movable arm of the movable contact arm set to a point of pick-up.
Figure 2C:
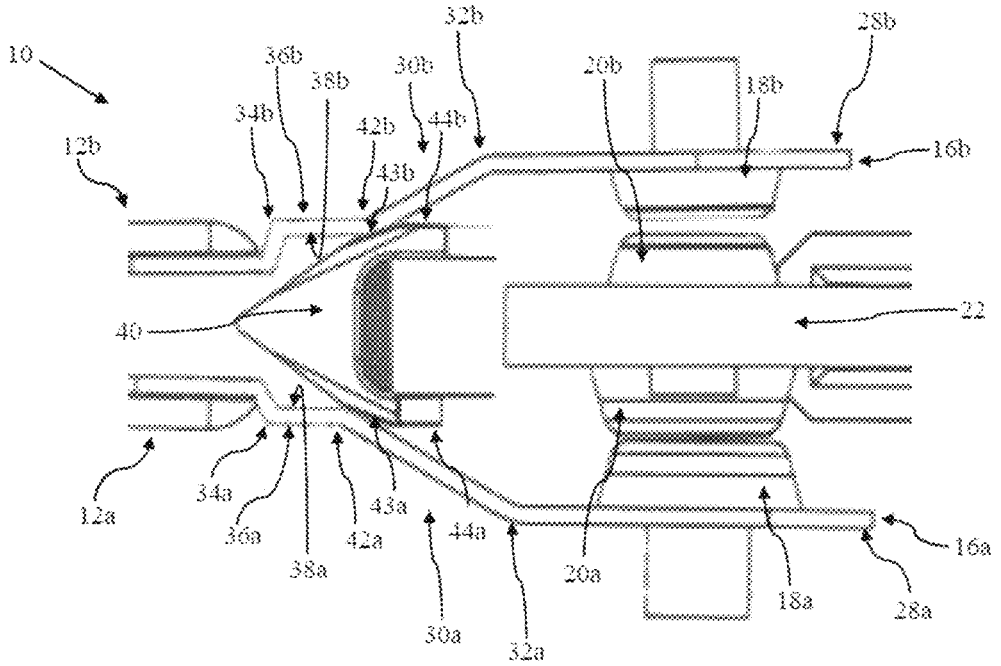
FIG. 2*c* shows an enlarged plan view of the contact region of the movable contact arm set of FIG. 2*b*, the movable contact arm set being intermediate a contacts-closed and contacts-open condition with the fixed contacts following further advancement of the wedge-shaped engagement member to a point of pick-up of the other movable contact arm.

FIGS. 2*b* and 2*c* show the approach towards and opening of the movable contact arm set 10 into an intermediate condition between a contacts-closed and contacts-open condition following advancement of the movable member 40. In this intermediate condition, the movable member 40 has been linearly actuated towards the first and second engagement surfaces 38*a*, 38*b*. A first lag actuation surface 43*b* of the movable member 40 as shown advances so as to contact with the second leading edge 42*b* of the second engagement surface 38*b*, as can be seen in FIG. 2*b*, which is closer to the second movable contact 18*b* than the first leading edge 42*a* is to the first movable contact 18*a*. This first lag actuation surface 43*b* has an angled profile so as to provide a consistently increasing force to the second leading edge 42*b* of the second movable contact arm 12*b*. In FIG. 2*b*, contact has been made by the movable member 40 with the second leading edge 42*b*, but the switch remains in a contacts-closed condition, and current is able to flow through both of the first and second movable contact arms 12*a*, 12*b*.

Upon further advancement of the movable member 40, the first lag actuation surface 43*b* presses against the second leading edge 42*b* such that the second movable arm 12*b* is flexed or otherwise been displaced such that the second minor body portion 28*b* is urged away from the fixed terminal 22, and this can be seen in FIG. 2*c*. This separates the second movable contact 18*a* from the second fixed contact 20*b*. The position shown in FIG. 2*c* shows the movable member 40 having advanced to such a position so as to achieve a point of pick-up on the first movable contact arm 12*a*. In FIG. 2*c*, the second movable contact arm 12*b* has been displaced as the movable member 40 contacts and force outwards the leading edge 42*b*. The second movable contact 18*b* is separated from the second fixed contact 20*b*; however, as this is a lag contact set, and the first movable and fixed contacts 18*a*, 20*a* remain closed, current can still flow through the lead contact set.

As the first leading edge 42*a* is only just about to come into contact with a first lead actuation surface 43*a* of the movable member 40 of the actuation element, no displacement of the first movable arm 12*a* has occurred. As such, electrical current can still flow through the first movable arm 12*a* and into the fixed terminal 22, and the switch is not opened. This permits the size of the or each second movable contact 18*b* to be reduced, since the effect of electrical arcing is minimised, since this is associated with the making or breaking of electrical contact in a switch.

Figure 2D:
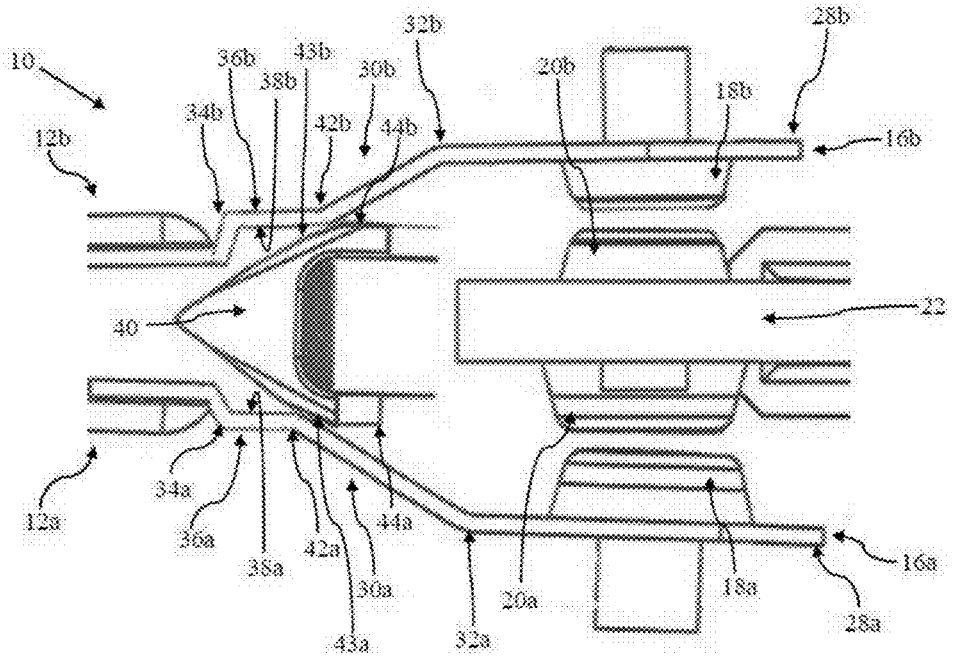
FIG. 2*d* shows an enlarged plan view of the contact region of the movable contact arm set of FIG. 2*c*, the wedge-shaped engagement member having advanced to contact the other movable arm of the movable contact arm past the point of pick-up.
Figure 2E:
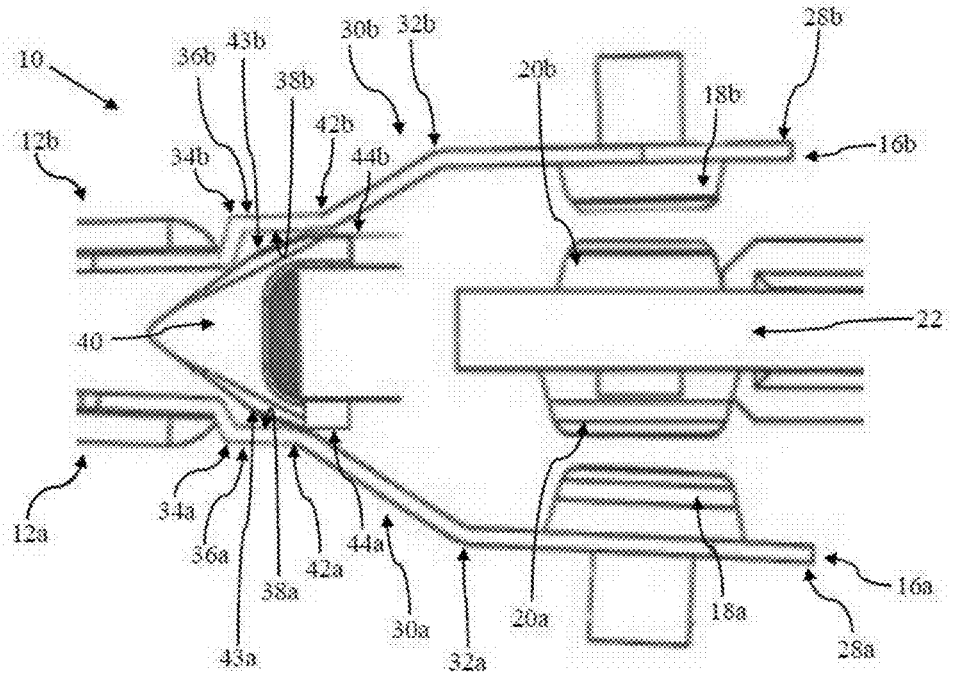
FIG. 2*e* shows a plan view of the movable contact arm set of FIG. 2*d*, the movable contact arm set being in a contacts-open condition with respect to the fixed contacts following further advancement of the wedge-shaped engagement member.

The complete opening of the movable contact arm set 10 is illustrated in FIGS. 2*d* and 2*e*, as the first and second movable contact arms 12*a*, 12*b* move into a contacts-open condition.

The movable member 40 of the actuations element is driven closer to the proximal ends of the first and second movable contact arms 12*a*, 12*b*, and in doing so, the first lead actuation surface 43*a* of the movable member 40 has now applied a force to the first engagement surface 38*a*; this can be seen in FIG. 2*d*. In doing so, the first minor body portion 28*a* is displaced relative to the fixed terminal 40, thereby breaking the connection between first movable contact 18*a* and the first fixed contact 20*a*, and by extension opening the switch. It is at this point that electrical arcing may occur. The effects of electrical arcing can therefore be mitigated by the increased size and/or resilience of the first movable contact 18*a* and the first fixed contact 20*a*. However, in the depicted embodiment, the actuation surface of the movable member 40 engaged with the second movable contact arm 12*b* has plateaued into a second lag actuation surface 44*b*, which now is or is substantially parallel to the second engagement surface 38*b* of the second movable contact arm 12*b*. This changes the force applied to the second movable contact arm 12*b*, providing a gentler, stepped opening and closing action. This in turn reduces a loading on the solenoid actuator with which the movable member 40 is associated.

A fully contacts-open condition can then be seen in FIG. 2*e*, in which the first movable and fixed contacts 18*a*, 20*a* have been separated to such a degree as to mitigate the effects of electrical arcing, the separation being too large to permit electrical discharge between the two contacts 18*a*, 20*a*. Notably, at the point of contact, the first lead actuation surface 43*a* of the wedge-shaped member 40 has contacted with the first engagement surfaces 38*a*, with a second lead actuation surface 44*a* having been urged into contact with the first engagement surface 38*a*, being parallel or substantially parallel therewith. As such, the first and second engagement surfaces 38*a*, 38*b* are parallel or substantially parallel with one another. This geometric arrangement is achieved by careful selection of the angular configurations of the contact-clearance and engagement shoulders 32*a*, 32*b*, 34*a*, 34*b*. As such, the loading on the actuator is reduced compared with prior arrangements.

The movable member 40 may also formed so as to be asymmetric, having a much longer train to contact the first engagement surface 38*a* than for the second engagement surface 38*b*. This may advantageously limit the propensity for or likelihood of contact bounce as the opening or closing force applied to the first engagement surface 38*a* is greatly extended and is much more uniform as a result. For a flexible movable contact arm 12*a*, there may be potential for flexion of the distal end 16*a* back towards the fixed contact 20*a* past the point of pick-up, potentially increasing the risk of contact bounce, and therefore the extended train ensures that a displacement force continues to be applied to the first leading edge 42*a*.

The closure of the movable contact arm set 10 is therefore illustrated by the reverse process, visualised from FIGS. 2*e* to 2*a*. With contact closure, the risk of electrical arcing occurs at the point of release of the movable member 40 from the first leading edge 42*a*, at which point the first movable and fixed contacts 18*a*, 20*a* come into proximity once more. Using such a movable contact arm set 10, it becomes possible to provide a simple means of providing lead-lag contact opening and closing for a switching contactor, which can limit the damage to the expensive materials of the movable and fixed contacts 18*a*, 18*b*, 20*a*, 20*b* which can occur during use. The careful selection of the stepped profile of the first and second movable contact arms 12*a*, 12*b* in the region of contact with the movable member 40 of the actuator therefore provides for accurate control over a lead-lag opening and closing sequence of the contactor.

Figure 3:
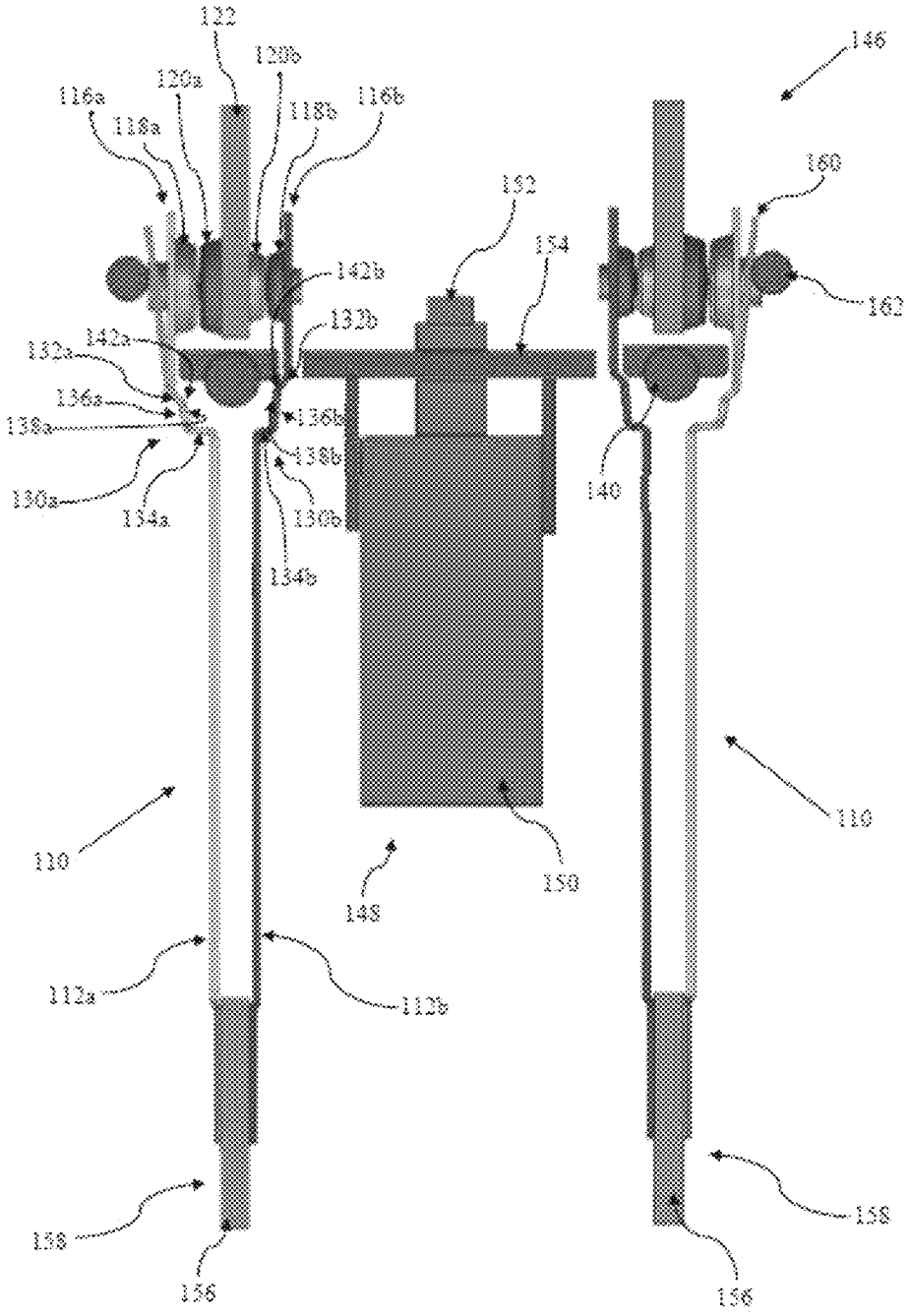
FIG. 3 shows a plan view of one embodiment of a two-pole electrical contactor in accordance with the second aspect of the invention.

A pair of a second embodiment of movable contact arm sets is illustrated in the context of a switching contactor, the switching contactor being illustrated globally as 146 in FIG. 3, with the movable contact arm sets as 110. Identical or similar components to those of the first embodiment will be referred to using identical or similar reference numerals respectively, and further detailed description is omitted for brevity.

The switching contactor 146 here comprises two movable contact arm sets 110 and an actuator assembly 148, typically but not necessarily exclusively formed as a magnet-latching solenoid actuator assembly. Here, the actuator assembly 148 has a main drive unit 150 which drives a plunger 152 along a linear axis. The plunger 152 is engaged with a movable bar 154, to which are engaged two wedge-shaped members 140, arranged to displace the respective first and second movable contact arms 112*a*, 112*b* of the movable contact arm sets 110 to effect opening and closing of the contact sets.

Each of the first and second movable contact arms 112*a*, 112*b* is engaged with a proximal terminal 156 at a first end 158, having first and second movable contacts 118*a*, 118*b* respectively at a second end 116*a*, 116*b*. The first and second movable contacts 118*a*, 118*b* are respectively displaceable with respect to first and second fixed contacts 120*a*, 120*b*, engaged with a fixed terminal 122.

Here, the first movable contact arms 112*a* are illustrated having a tang 160 and peg 162 arrangement which serves to aid a contact pressure on the first movable contact 118*a* to limit contact bounce during operation.

The stepped portions 130*a*, 130*b* of the first and second movable contact arms 112*a*, 112*b* are different to that of the embodiment depicted in FIG. 1 and FIGS. 2*a* to 2*e*; the asymmetry is not only provided by the longitudinal displacement of the leading edges 142*a*, 142*b* of the engagement surfaces 138*a*, 138*b*, but there is also a lateral or perpendicular asymmetry. This is here achieved by difference depths and/or angular positioning of at least one of the primary and secondary shoulders 132*a*, 132*b*, 134*a*, 134*b* between the first and second movable contact arms 112*a*, 112*b*.

In use, the wedge-shaped member 140 is actuated towards the leading edges 142*a*, 142*b* by the actuator assembly 148. Notably, the arrangement of the wedge-shaped member shown is such that it may contact the primary shoulders 132*a*, 132*b* of the movable contact arms 112*a*, 112*b* before contacting with the respective leading edges 142*a*, 142*b* and therefore pick-up of the movable contact arms 112*a*, 112*b* may occur prior to contact with the leading edges 142*a*, 142*b*, thereby creating a two-stage pick-up.

The wedge-shaped member 140 will not only contact the second primary shoulder 132*b* and leading edge 142*b* prior to the first primary shoulder 132*a* and leading edge 142*a* when opening the contacts as a result of the relative longitudinal positioning of the primary shoulders 132*a*, 132*b* and leading edges 142*a*, 142*b*, but also as a result of the relative lateral positions of the engagement surfaces 138*a*, 138*b*, due to the wedge-shape of the wedge-shaped member 140.

It can also be seen that the angular configuration or slope of the first primary and secondary shoulders 132*a*, 134*a* is different to that of the second primary and secondary shoulders 132*b*, 134*b*. These angular configurations or slopes can be formed so as to alter the timing sequence between the lead and lag movable contacts 118*a*, 118*b*; a gentler slope on one of the primary and secondary shoulders 132*a*, 132*b*, 134*a*, 134*b* will result in a gentler opening of the respective contact 118*a*, 118*b*. A run of the engagement surface 138*a*, 138*b* can be chosen so as to ensure a stable opening and closure force, minimising the likelihood of contact bounce.

Figure 4:
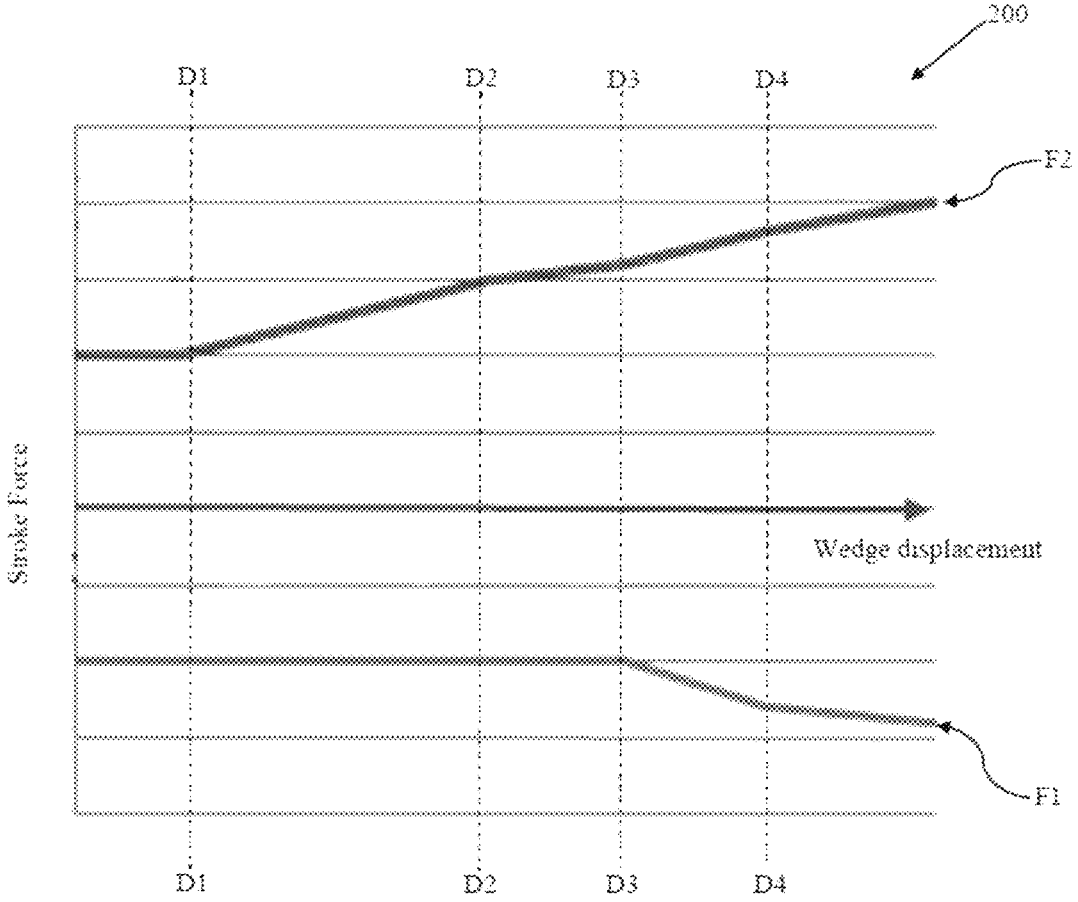
FIG. 4 shows a qualitative graph of the stroke force applied to the movable contact arms of the electrical contactor of FIG. 3 with respect to the displacement of the wedge-shaped member of an actuator thereof.

As such, the opening and closing of the switching contactor 146 will operate with a lead-lag effect, and, in doing so, achieve the same kind of benefits to those described above. A qualitative graph of the stroke force applied to the first and second movable contact arms 112*a*, 112*b* is illustrated in FIG. 4 globally at 200. The lower line F1 represents the force applied to the first movable contact arm 112*a* and the upper line F2 represents the force applied to the second movable contact arm 112*b*.

As the movable member 140 advances toward the movable contact arms 112*a*, 112*b*, it will first pick-up the second primary shoulder 132*b*, and this is indicated at point D1 in FIG. 4. The force increases as the movable member 140 is pressed further across the angled engagement surface 138*b*. At point D2, the wedge-shaped member 140 will contact the second leading edge 142*b* of the second movable contact arm 112*b*, leading to the stepped force graph shown.

As the wedge-shaped member 140 advances further, it will pick-up the first primary shoulder 132*a*, at point D3 illustrated. The first movable contact arm 112*a* therefore begins to be displaced as the wedge-shaped member 140 advances, and is displaced further still as the wedge-shaped member 140 contacts with the leading edge 142*a* of the first movable contact arm 112*a*. This leads to the advantageous lead-lag contact opening and closing arrangement as detailed above. The stepped force profile, which ensures that force applied to the movable contact arms 112*a*, 112*b* does not plateau following first engagement by the actuator 148 further limits the ability of the switching contactor 146 to experience contact bounce in normal operation.

Such a stepped engagement surface 138*a*, 138*b* ensures that a gentle pick-up of the respective movable contact arms 112*a*, 112*b* occurs, resulting in greater control over the pick-up. This in turn allows for more consistent timing to be applied to the contact opening process, limiting the chances for deleterious opening or closing conditions to be experienced. A fast opening limits the chance of electrical arcing, and this can be provided for by providing relatively steep first and second primary shoulders 132*a*, 132*b*. Once the danger of electrical arcing has receded, that is, once the first movable and fixed contacts 118*a*, 120*a* are sufficiently separate, then the gentler slope of the moving-member-engagement body portions 136*a*, 136*b* provides the controlled later urging of the movable contact arms 112*a*, 112*b* which allows for precise chronal control.

It is therefore apparent that the above-described arrangements allow for a method of providing a lead-lag contact opening arrangement for a switching contactor 146, which comprises the steps of providing a pair of movable contact arms 112*a*, 112*b* of the switching contactor 146 which are asymmetric to one another, and then applying a linear actuation force towards the pair of movable contact arms 112*a*, 112*b* such that the movable contact arms 112*a*, 112*b* are displaced relative to one another asynchronously. The asymmetry of the movable contact arms 112*a*, 112*b* ensures that a movable member 140 of the switching contactor 146 is able to convert a linear actuation force into a delayed lead-lag contact opening arrangement by careful selection of the engagement surfaces 138*a*, 138*b* of the first and second movable contact arms 112*a*, 112*b*.

It will be appreciated that wherever the terms movable or fixed contact have been utilised above, that the plural could apply; multi-bladed movable contact arms having more than one movable contact thereon are known in the art, and the present invention should not be taken to exclude such arrangements.

Similarly, whilst flexible electrically-conductive movable contact arms are illustrated, it will be apparent that a pivotable, hinged or similarly displaceable movable arm arrangement could alternatively be provided. Curved or parabolic asymmetric movable arms could also be provided, where the wedge-shaped engagement member contacts a curving engagement surface so as to provide a smooth opening profile. However, such an arrangement is likely to be less resilient to tolerances in the manufacturing of the movable members when compared with the above-described embodiments of the invention, which provides well-defined and achievable pick-up points for the wedge-shaped member, resulting in consistency in the opening gaps. Similarly, the above embodiments, having accurately plateaued engagement surfaces, ensure rapid and decisive opening and closing of the contacts, so as to ensure rapid quenching of any electrical arcing which may have formed.

It is therefore possible to provide a movable contact arm set which permits a lead-lag contact opening and closing arrangement, in particular for use with switching contactors. By careful selection of the shape of the movable contact arms, such that they are asymmetric with respect to one another, it is possible to achieve asynchronous opening and/or closing of the respective movable contacts on the first and second movable contact arms, thereby achieving the benefits associated with lead-lag contact arrangements without needing to provide a bespoke or complicated actuator arrangement. The physical form of the first and second movable contact arms ensures that the correct lead-lag contact opening and closing sequences are enforced, since the movable contact arms are physically and outwardly displaced by the actuation of the movable member of the actuator.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. A movable contact arm set for a switching contactor, the movable contact arm set comprising: first and second movable contact arms which respectively carry first and second movable contacts, the first and second movable contact arms respectively having first and second engagement surfaces which are engagable with an actuation element to permit displacement of the first and second movable contacts, the first and second engagement surfaces being asymmetric to one another to permit the displacement of the first and second movable contacts asynchronously; wherein a leading edge of the first engagement surface is positioned further from the first movable contact than a leading edge of the second engagement surface is from the second movable contact.

2. The movable contact arm set as claimed in claim 1, wherein each of the first and second movable contact arms has an elongate body having a stepped portion therein, the respective stepped portions defining the first and second engagement surfaces.

3. The movable contact arm set as claimed in claim 2, wherein the each of the stepped portions of the first and second movable contact arms comprise primary and secondary different shoulders.

4. The movable contact arm set as claimed in claim 2, wherein the stepped portion of the first movable contact arm is larger than the stepped portion of the second movable contact arm.

5. The movable contact arm set as claimed in claim 2, wherein the stepped portion of the first movable contact arm is larger than the stepped portion of the second movable contact arm in a direction of a longitudinal axis of the respective elongate bodies.

6. The movable contact arm set as claimed in claim 2, wherein the stepped portion of the first movable contact arm is larger than the stepped portion of the second movable contact arm in a direction perpendicular to a longitudinal axis of the respective elongate bodies.

7. The movable contact arm set as claimed in claim 2, wherein the elongate body is formed from a resiliently flexible electrically-conductive material.

8. The movable contact arm set as claimed in claim 1, wherein an angular orientation of the first engagement surface is different to that of the second engagement surface.

9. The movable contact arm set as claimed in claim 1, wherein the first movable contact is formed as a lead contact and the second movable contact is formed as a lag contact.

10. A switching contactor comprising:

first and second terminals;

first and second movable contact arms which respectively carry first and second movable contacts, the first and second movable contact arms respectively having a stepped portion, each of the stepped portions of the first and second movable contact arms comprising at least primary and secondary shoulders, the first and second movable contact arms respectively having first and second engagement surfaces;

the first and second movable contact arms being connected to the first terminal;

first and second fixed contacts connected to the second terminal; and an actuation element having a movable member engagable with the first and second engagement surfaces to permit asynchronous displacement of the first and second movable contacts relative to the first and second fixed contacts.

11. The switching contactor as claimed in claim 10, wherein the movable member is a wedge-shaped member engagable with the first and second engagement surfaces.

12. The switching contactor as claimed in claim 11, wherein the wedge-shaped member has a stepped actuation surface.

13. A method of providing a lead-lag contact opening arrangement for a switching contactor, the method comprising the steps of providing a pair of movable contact arms of the switching contactor which are asymmetric to one another, wherein a leading edge of the first engagement surface is positioned further from the first movable contact than a leading edge of the second engagement surface is from the second movable contact, and applying a linear actuation force towards the pair of movable contact arms such that the movable contact arms are displaced asynchronously to one another.

* * * * *